US006763938B1

(12) United States Patent
Nelson

(10) Patent No.: US 6,763,938 B1
(45) Date of Patent: Jul. 20, 2004

(54) KEY HOLDING DEVICE

(76) Inventor: George B. Nelson, 107 Meadowcreek Dr., Duncanville, TX (US) 75137

( * ) Notice: Subject to any disclaimer, the term of this patent is extended or adjusted under 35 U.S.C. 154(b) by 96 days.

(21) Appl. No.: 10/099,330

(22) Filed: Mar. 15, 2002

(51) Int. Cl.[7] ..... A45C 11/32

(52) U.S. Cl. ..... 206/37.1; 206/37.4; 206/38.1; 206/825

(58) Field of Search ..... 206/37.1, 37.2, 206/37.3, 37.4, 37.5, 37, 38.1, 38, 349, 804, 815, 825, 459.5, 1.5; 70/456 R, 459

(56) References Cited

U.S. PATENT DOCUMENTS

| | | | | |
|---|---|---|---|---|
| 1,936,273 A | * | 11/1933 | Segal | 206/37.2 |
| 1,996,933 A | * | 4/1935 | Segal | 206/37.2 |
| 2,076,895 A | | 4/1937 | Johnston | |
| 2,541,333 A | | 2/1951 | Campbell | |
| 2,605,632 A | * | 8/1952 | Lamonde | 70/456 R |
| 3,004,422 A | * | 10/1961 | Starrett | 70/456 R |
| 3,354,678 A | | 11/1967 | Stifelman | |
| 3,407,636 A | * | 10/1968 | Kovacevic | 206/37.2 |
| 3,765,200 A | | 10/1973 | Vogt | |
| D364,502 S | | 11/1995 | Howard | |
| 5,833,054 A | | 11/1998 | Graves | |
| 6,089,060 A | * | 7/2000 | Steeley | 70/456 R |

FOREIGN PATENT DOCUMENTS

| | | |
|---|---|---|
| EP | 1034717 A1 | 9/2000 |
| WO | WO 97/17863 A1 | 5/1997 |

* cited by examiner

*Primary Examiner*—Gregory Pickett
*Assistant Examiner*—John G. Pickett
(74) *Attorney, Agent, or Firm*—Locke Liddell & Sapp LLP

(57) ABSTRACT

A key holding device for holding at least one key containing a first compartment for holding a key and a second compartment for holding a strap. A clasp is mounted to the key and a cap is used to attach the clasp to the strap. The key is inserted and locked inside the first compartment using a locking mechanism. To access the key, the bottom end of the clasp is pressed to disengage the locking mechanism to unlock and remove the key from the compartment. The key can be rotated and configured for insertion into the desired device. The key can be easily removed from the case by detaching the cap from the clasp. Once removed, the strap retracts inside the second compartment by a biasing mechanism.

19 Claims, 4 Drawing Sheets

KEY HOLDING DEVICE

TECHNICAL FIELD OF THE INVENTION

The present invention relates to a key holding device for holding multiple keys. More particularly, the present invention relates to a key holding device having multiple compartments to store and easily access keys for use.

BACKGROUND OF THE INVENTION

There are numerous key storage cases designed for carrying in a purse or pocket. These key cases often contain a housing having multiple slots to store a key; however, there are numerous disadvantages with these configurations. For example, if the user desires to have a key case capable of storing multiple keys, the devices become bulky and inconvenient to store in a pocket or purse. Additionally, many key holding devices are difficult to open and close and require the use of two hands and excessive manipulation to separate the desired key, then to turn that key with the cut side up or down to fit inside the desired device. This is especially burdensome when a user is carrying other objects and has only one free hand to access a key.

The present invention is designed to overcome these disadvantages by providing a key case capable of holding multiple keys in a compact fashion so as to allow the user to easily and comfortably carry such devices in a small purse or a pocket having simple operation.

SUMMARY OF THE INVENTION

The present invention relates to a key holding device whereby a multiplicity of keys can be stored inside a key storage area. Each key is stored in a separate compartment, cut side up or down as needed, and is attached to the device by use of a hanger assembly. The hanger assembly includes a clasp attached to a key and a strap to connect the clasp and key to the key holding device. The hanger assembly allows the user to place the key between a storage position, where the key is locked inside the key holding chamber, and a use position, where the key is freely positioned outside the chamber in order to be inserted into the desired device.

While in the storage position, a user can disengage a locking mechanism, which locks and holds the key inside the key holding chamber. Once unlocked, the hanger assembly and key can be pulled outward until the key is completely removed from the key storage area. At this point, the key can be pivoted and rotated for insertion into the desired device. A biasing mechanism retracts a portion of the strap inside the key holding device to shorten the exposed portion of the strap. If it is desired to remove the key from the device, a cap, located on the top portion of the clasp, can be removed thus separating the key from the hanger assembly. Upon separation, the biasing mechanism retracts the strap and cap inside the key holding device in a locked position. To re-attach the key to the hanger assembly, the hanger is pulled outward from the device and the cap is re-connected to the clasp.

After use, the key is rotated and pivoted so that it is aligned with a slot opening on the key holding chamber. Once aligned, key is then inserted inside the device for storage.

The key holding device is designed to accommodate multiple keys and can have various configurations. Keys can be inserted from the top end of the device and/or the bottom end of the device. The number of keys is directly related to the desired size of the overall case.

BRIEF DESCRIPTION OF THE DRAWINGS

For a more complete understanding of the invention and for further advantages thereof, reference is now made to the following Description of the Preferred Embodiments taken in conjunction with the accompanying Drawings in which.

DESCRIPTION OF THE PREFERRED EMBODIMENTS

Figure 1:
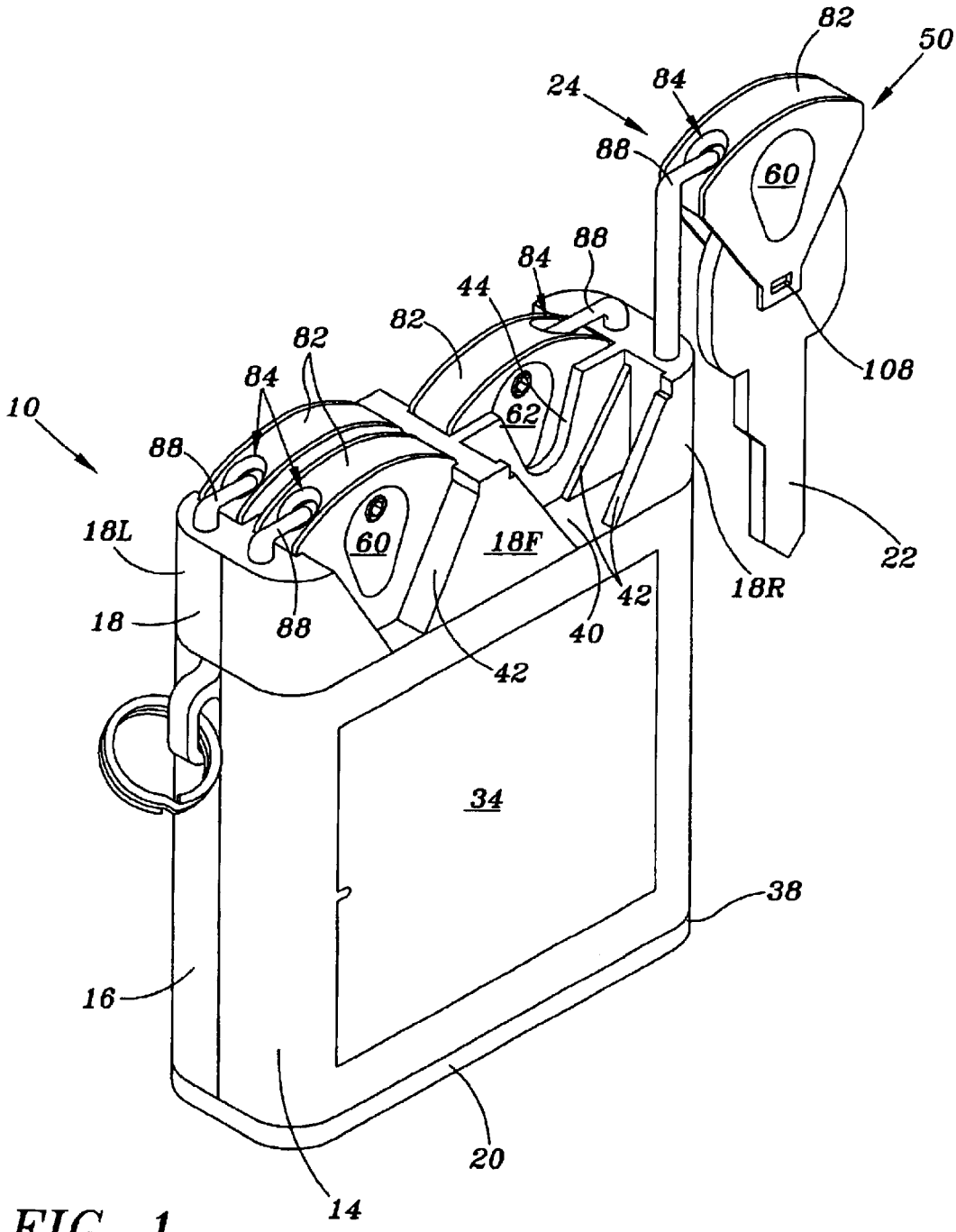
FIG. 1 is a perspective view of the key holding device illustrating a key removed from a key holding compartment.
Figure 2:
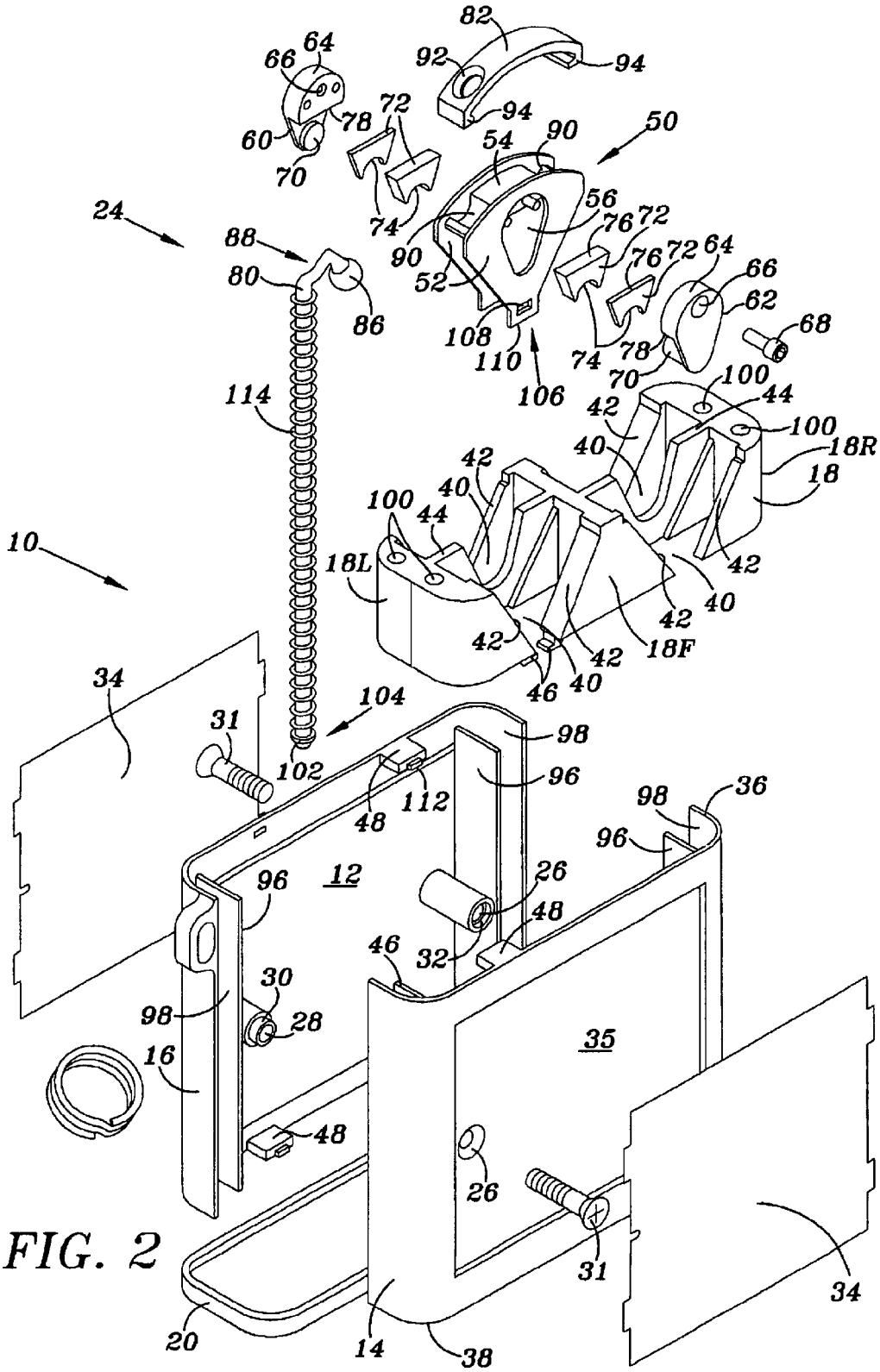
FIG. 2 is an exploded perspective view of the key holding device illustrated in FIG. 1.

As illustrated in FIGS. 1 and 2, key case 10 includes a key storage area or cavity 12 formed by a first housing wall 14, a second housing wall 16, an end cap 18 and a bottom cap 20. A key 22 is connected to case 10 by a hanger assembly 24 to allow the key to be placed between a storage position (FIG. 3), where the key is locked inside the storage area 12, and a use position (FIG. 5), where the key is removed from storage area 12.

Referring to FIG. 2, first housing wall 14 and second housing wall 16 are connected together by aligning tubular threaded openings 26 and 28 on wall 14 with openings 26 and 28 on wall 16 (only one opening 26 is illustrated on wall 16). Once aligned, screws 31 are inserted in the aligned openings to fasten housing walls 14 and 16 together to prevent separation. Threaded opening 26 and 28 protrude outward from housing walls 14 and 16 into chamber 12 and are of sufficient length so that exterior annular ridge 30 fits inside interior annular ridge 32 to provide a snug fit when assembling housing walls 14 and 16. Tubular threaded openings 26 and 28 are formed along the outer edges of chamber 12 to prevent interference when storing keys inside chamber 12. A cover 34 is placed inside cavity 35 and is attached to housing walls 14 and 16 to cover openings 26. Cover 34 is preferably fabricated from a flexible material and can be clear so that a small photo or other writing can be placed inside cavity 35 and covered by cover 34.

In a preferred embodiment, end cap 18 is placed on the top end 36 of storage area 12 and a bottom cap 20 is placed on the bottom end 38 of storage area 12. End cap 18 contains multiple slots 40 which are used to guide keys 22 inside storage area 12. Slot 40 is formed by slot side boundaries 42 which have sloped or "v" shaped configurations in order to allow the user to grasp and unlock the key from the storage area (discussed in detail below). Other shapes and configurations of side boundaries 42 can be used including for example, semicircular shaped boundaries as long as a sufficient opening is present to allow the user to grasp the key from the slot.

In the embodiment shown in FIGS. 1 and 2, end cap 18 contains four slots 40, however, it should be realized by one of ordinary skill in the art that a greater or fewer number of slots 40 can be used depending on the desired size (i.e., the thickness) of storage area 12. End cap 18 also includes a cross support 44 that extends across the width of slot 40 and separates the adjacent slots. In addition to separating slots 40, cross support 44 acts as an additional support for cap 18. Bottom cap 20 is configured to enclose bottom end 38 of case 10 and has a flat surface in order to rest key case 10 in an upright and vertical position.

In yet another embodiment, bottom cap 20 is replaced with a second end cap 18 so that additional keys 22 can be inserted inside storage area 12 from both top end 36 and bottom end 38, as seen in FIGS. 3–6. In the end cap illustrated in FIG. 2, slots 40 on cap right side 18R are slightly offset from openings on cap left side 18L. Referring specifically to openings 40 on cap left side 18L, opening 40 is offset from cap front end 18F a distanced slightly greater than the corresponding slot 40 on cap right side 18R. Thus, when key case 10 contains a cap 18 on each end (i.e., top end 36 and bottom end 38), caps 18 can be attached such that keys 22 will be offset while inserted inside key storage area 12. In this offset configuration, the key ends are prevented from contacting each other when fully inserted inside storage area 12. End cap 18 is connected to walls 14 and 16 by placing mounting arms 46 underneath a protrusion 48 when walls 14 and 16 are connected during assembly.

A clasp 50 attaches to key 22 and contains two opposed and spaced apart sidewalls 52 separated by transverse support member 54. Support member 54 provides sufficient clearance to insert key 22 between sidewalls 52. Each clasp sidewall 52 contains an opening 56 for alignment with opening 58 on key 22 (FIGS. 3–6). Once aligned, a left vise 60 and a right vise 62 are aligned and inserted through clasp sidewall openings 56. Each vise is shaped to fit snug inside clasp sidewall opening 56 when properly mounted. Vises 60 and 62 contain an upper portion 64 that contains a threaded opening 66 to receive a screw 68. Vises 60 and 62 both contain a rounded lower portion where an extension 70 is attached such that the extensions are aligned and inserted through opening 58 on key 22 to connect key 22 to vises 60 and 62. In a preferred embodiment, extensions 70 contain a small circular cross section in order to allow attachment to any size or shape of opening 58. As extensions 70 are aligned through opening 58 and threaded openings 66 on vises 60 and 62 are adjacent and aligned with each other, screw 68 is inserted therein to lock the vises together to prevent key 22 from separating from between sidewalls 52.

Because key 22 can vary in thicknesses, key pads 72 are optionally mounted between left vise 60, right vise 62 and key 22 to act as "spacers." Spacers 66 contain a semicircular cut-out 74 along the bottom boundary for mounting above extensions 70 and have a top boundary 76 to mate with a flat ridge 78, located on the bottom surface of vise top portion 64. Spacers 72 are used, if needed, to maintain a fixed relation between key 22 and clasp 50.

Figures 5, 6:
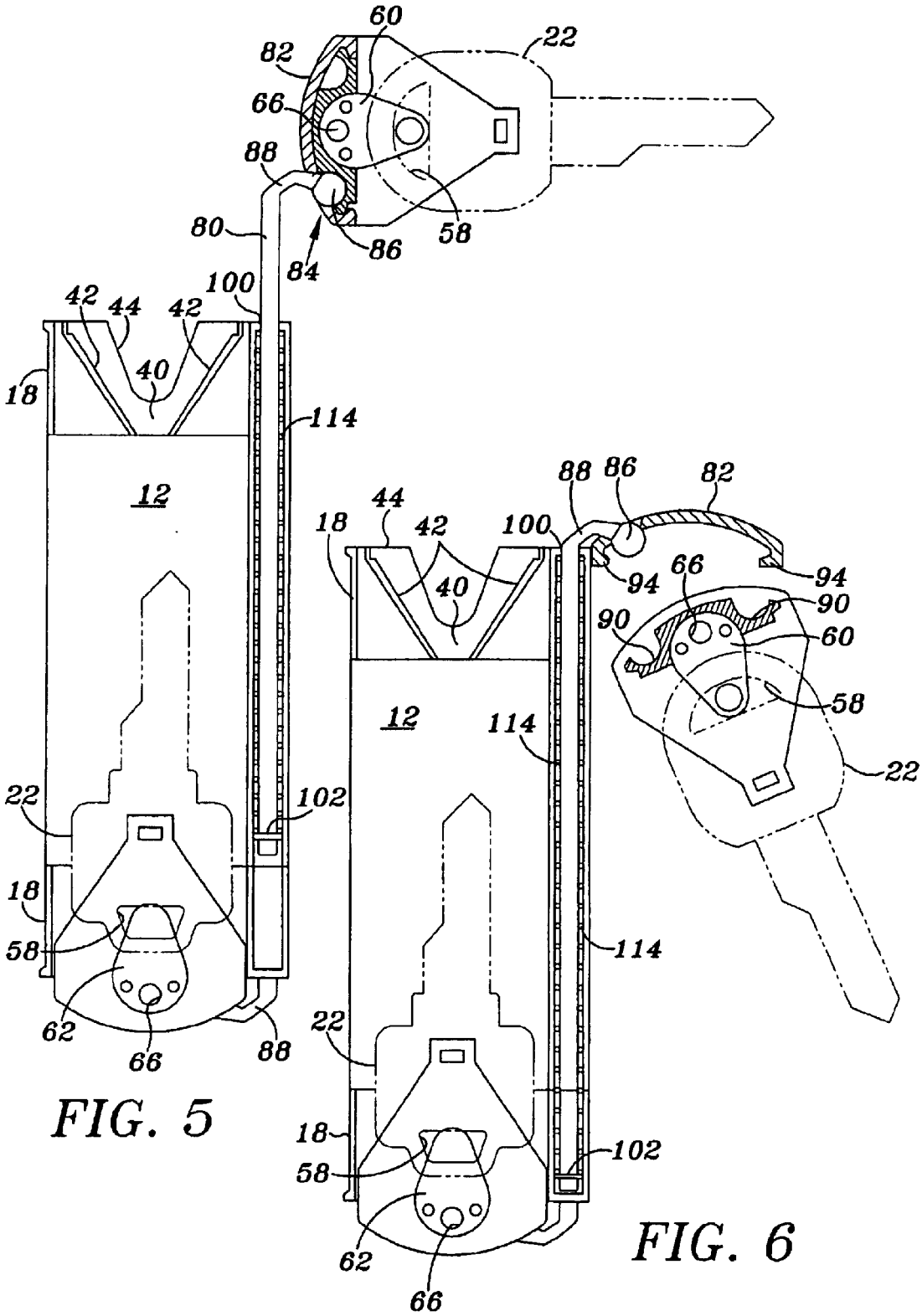
FIG. 5 is a cross section view of a compartment of the key holding device in FIG. 1 illustrating the key in the use position.
FIG. 6 is a cross section view of a compartment of the key holding device in FIG 1 illustrating the key separated from the hanger and the strap fully retracted inside the case.

Referring to FIG. 2, hanger assembly 24 attaches key 22 to key case 10. Hanger assembly includes a flexible wire strap 80 connected to a cap 82 by a ball joint 84. Ball joint 84 includes a spherical end 86 connected to a first end 88 of strap 80 for placement inside a cavity 90. Clasp 50 contains a cavity 90 on the right and left side to allow the user to connect cap 82 and spherical end 86 on either side of clasp 50, whichever is necessary. Referring specifically to FIG. 6, the diameter of sphere 86 is slightly larger than opening 92 to prevent cap 82 from separating from strap first end 88. Ball joint 84 permits cap 82 to be pivotably mounted to strap 80 so that key 22 can rotate and pivot during use. Cap 82 is attached to clasp 50 by snapping cap ends 94 around clasp transverse support member 54.

Figure 3:
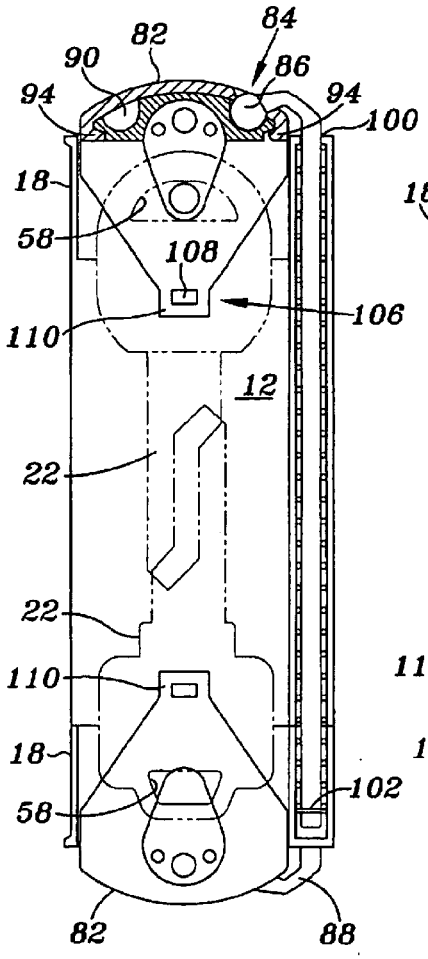
FIG. 3 is a cross section view of a compartment of the key holding device in FIG. 1 illustrating a key in the storage position.
Figure 4:
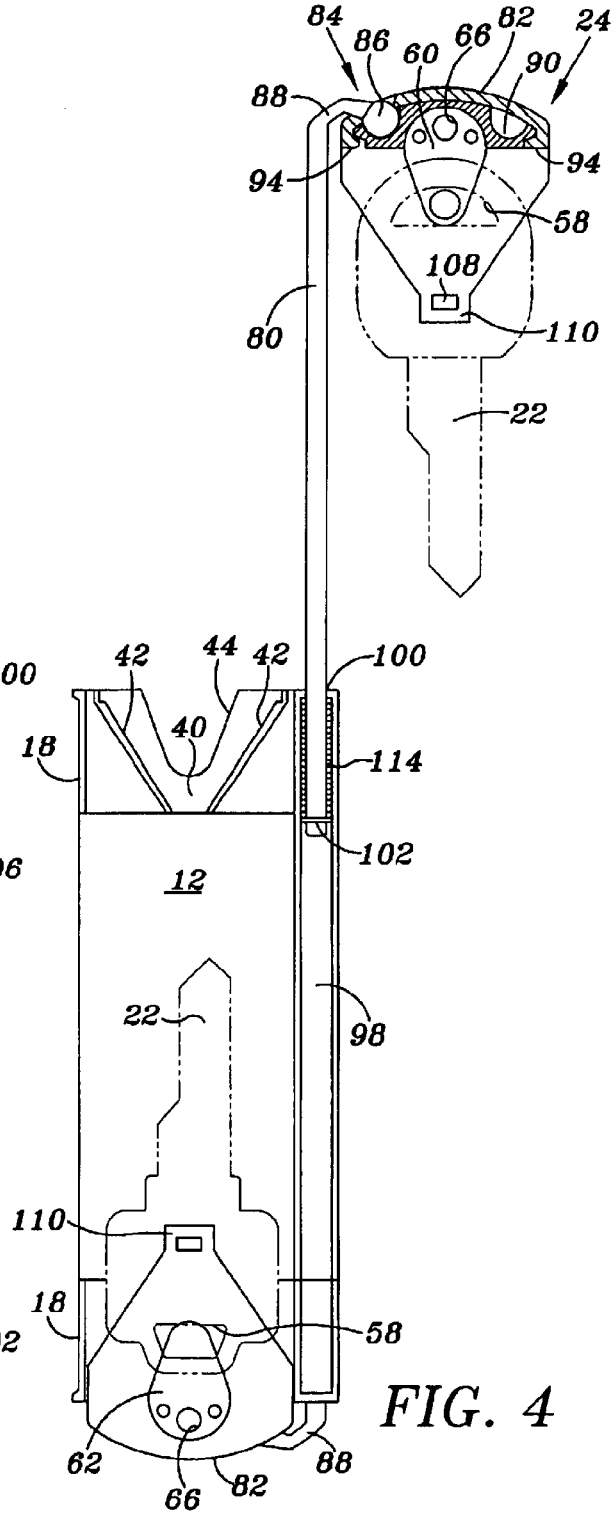
FIG. 4 is a cross section view of a compartment of the key holding device in FIG. 1 illustrating the key extended from the storage position.

Referring to FIG. 2, an interior sidewall 96 forms a hollow strap compartment 98 to house strap 80. As seen in FIGS. 3–5, strap compartment 98 extends the entire height of case 10 so that strap 80 can be stored therein while in the storage position (FIG. 3). When in the storage position, as seen in FIG. 3, strap first end 88 extends outside strap compartment 98 through opening 100. The diameter of opening 100 is slightly larger than the diameter of strap 80 so that the strap can slide through the opening (FIGS. 3–5). A retainer ring 102 located on strap second end 104 prevents strap 80 from disconnecting with key case 10 when fully extended from strap compartment 88.

FIG. 3 illustrates keys 22 stored and locked in the storage position by locking mechanism 106. Locking mechanism 106 includes a cavity 108, located on clasp lower end 110 and is configured to receive locking extension 112, found on protrusion 48 located on interior of first and second housing walls 14 and 16 (FIG. 2). Clasp lower ends 110 are fabricated from a flexible material so that as the user removes the key from the storage position, the user can insert a finger between side boundaries 42 to apply a slight forced to ends 110 to separate cavity 108 from extension 112. This provides sufficient clearance to remove key 22 from storage area 12.

As key 22 is removed from storage area 12 (FIGS. 4–5), a biasing mechanism or spring 114, located between opening 100 and retainer ring 102, is compressed. Spring 114 is sized to fit around flexible strap 80 and extend from strap first 88 end to strap second end 104. Strap compartment 98 is sufficiently sized such that the width prevents the spring from tangling or bending apart from wire strap 80. Once the entirety of key 22 is removed from storage area 12, the key is turned (FIG. 4) and pivoted (FIG. 5) so key 22 can be inserted into the desired device. While in the use position (FIG. 5), spring 114 expands to partially retract strap 80 inside strap compartment 98. The length of spring 114, while key 22 is in the use position, is dependent upon the weight of case 10 in combination with the keys stored inside storage area 12. This reduces the amount of slack from wire strap 80 in order to provide a more compact device.

FIG. 6 illustrates key 22 removed from hanger 24. Removal of key 22 requires the user to disengage cap 82 from transverse support member 54 by applying a slight force to cap end 94 sufficient to deform the cap to remove it from transverse support member 54. Once removed, spring 114 retracts strap 80 inside strap compartment 98, as seen in FIG. 6, where it is locked in place.

Key case 10 can be fabricated from any suitable material such as plastic or metal. Furthermore, key case 10 can be fabricated to accommodate as few as one key, depending on the desired size.

Alternatively, cover 34 (FIGS. 1 and 2) can be replaced with a door to define an entranceway for a second separate compartment in storage area 12 (not shown) to store small items such as jewelry or make-up, etc. This separate compartment can used to store other accessories such as a garage door opener, a flash light, a digital clock, a car security system remote, etc. Additionally, an external pocket (not shown) can replace cover 34 so that credit cards, drivers licenses, cash and other objects can be stored.

When multiple slots 40 are used, an identifier (not shown) can be placed adjacent each slot to allow the user to determine which slot to access. Preferably, each slot is identified by a raised portion on walls 14 and 16 adjacent to each slot 40 such that when the user desires to select a key, the user touches the raised portion to identify corresponding slot 40. Additionally, identifiers can be placed on top of hanger cap 82.

Although the preferred embodiments of the present invention have been illustrated in the accompanying drawings and described in the foregoing Description of the Preferred Embodiments, it will be understood that the invention is not limited to the embodiments disclosed but is capable of numerous rearrangements, modifications, and substitutions of parts and elements without departing from the spirit of the invention.

I claim:

1. A key case for holding at least one key comprising:

a housing having a first and second compartment said housing defined by a top boundary, a bottom boundary, a first sidewall and a second sidewall wherein said first and second compartments are separated by an interior sidewall;

a hanger assembly including a strap attached to said housing, a cap pivotably connected to said strap, and a clasp adapted to be mounted to the key, said clasp being releasably mounted to said cap for removing the key from said housing without removal of the clasp from the key, said cap including a first end groove and a second end groove and said clasp including transverse support member adapted to engage said first and second end grooves, wherein when said clasp is attached to said cap, said transverse support member engages said grooves;

said housing top boundary contains a first opening defining an entrance to said first compartment and said housing top boundary further comprising a second opening adjacent said first opening defining an entrance to said second compartment;

wherein the key can be placed between a storage position and a use position wherein when the key is in said storage position the key is locked inside said first compartment and said strap is housed inside said second compartment and when the key is in said use position the key is removed from said first compartment and said strap is partially extended from said second compartment; and a biasing mechanism mounted inside said second compartment to apply retraction force to said strap when said strap is extended from said use position to partially retract said strap inside said second compartment to remove any excess slack that remains when the key is in said use position.

2. The key case of claim 1 wherein said housing contains multiple first and second compartments and said top boundary has multiple first and second openings to store a plurality of keys.

3. The key case of claim 1 wherein said bottom boundary contains a first and second opening.

4. The key case of claim 3 wherein said bottom boundary contains multiple first and second openings to store a plurality of keys.

5. The key case of claim 1 wherein said biasing mechanism is a compression spring.

6. The key case of claim 1 wherein said hanger assembly is locked in said storage position by a locking mechanism wherein said locking mechanism comprises a cavity located on said clasp to receive an extension located on said housing wherein when said extension is housed inside said cavity said hanger assembly remains locked inside said storage position and when said cavity is separated from said extension said hanger assembly can be placed in said use position.

7. The key case of claim 1 wherein at least one spacer can be placed between said clasp and the key to adapt the key to said clasp.

8. The key case of claim 1 wherein said housing is fabricated from plastic.

9. The key case of claim 1 wherein said housing is fabricated from metal.

10. A key case for holding at least one key comprising:

a housing defined by a top boundary, a bottom boundary and a side boundary;

a hanger assembly including a strap attached to said housing, a cap pivotably connected to said strap, and a clasp adapted to be mounted to the key, said clasp being releasably mounted to said cap for removing the key from said housing without removal of the clasp from the key, said cap including a first end groove and a second end groove and said clasp including transverse support member adapted to engage said first and second end grooves, wherein when said clasp is attached to said cap, said transverse support member engages said grooves;

said top boundary contains a first opening defining an entrance to a first compartment and said top boundary further comprising a second opening adjacent said first opening defining an entrance to a second compartment; and wherein the key can be placed between a storage position and a use position wherein when the key is in said storage position the key is locked inside said first compartment and said strap is housed inside said second compartment and when the key is in said use position the key is removed from said first compartment and said strap is partially extended from said second compartment.

11. The key case of claim 10 wherein said top boundary has multiple first and second openings to store a plurality of keys.

12. The key case of claim 10 wherein said bottom boundary contains a first and second opening.

13. The key case of claim 12, wherein said bottom boundary contains multiple first and second openings to store a plurality of keys.

14. The key case of claim 10 wherein said strap is retractable inside said second compartment by a biasing mechanism when said strap is extended in said use position to partially retract said strap inside said second compartment to remove any excess slack that remains when the key is in said use position.

15. The key case of claim 14 wherein said biasing mechanism is a compression spring.

16. The key case of claim 10 wherein said hanger assembly is locked in said storage position by a locking mechanism wherein said locking mechanism comprises a cavity located on said clasp to receive an extension located on said side boundary wherein when said extension is housed inside said cavity said hanger assembly remains locked inside said storage position and when said cavity is separated from extension said hanger assembly can be placed in said use position.

17. The key case of claim 10 wherein said clasp contains at least one spacer to adapt the key to said clasp.

18. The key case of claim 10 wherein said housing is fabricated from plastic.

19. The key case of claim 10 wherein said housing is fabricated from metal.

* * * * *